US010260243B1

(12) United States Patent
Chen

(10) Patent No.: US 10,260,243 B1
(45) Date of Patent: Apr. 16, 2019

(54) TILE LEVELING STRUCTURE

(71) Applicant: PLUS CRAFT INDUSTRIAL CO., LTD., Taichung (TW)

(72) Inventor: Timmy Chen, Taichung (TW)

(73) Assignee: Plus Craft Industrial Co., Ltd., Taichung (TW)

( * ) Notice: Subject to any disclaimer, the term of this patent is extended or adjusted under 35 U.S.C. 154(b) by 0 days.

(21) Appl. No.: 16/027,452

(22) Filed: Jul. 5, 2018

(51) Int. Cl.
*E04F 21/22* (2006.01)

(52) U.S. Cl.
CPC ..... *E04F 21/22* (2013.01)

(58) Field of Classification Search
CPC ..... E04F 21/22
See application file for complete search history.

(56) References Cited

U.S. PATENT DOCUMENTS 20,913 A * 7/1858 Wight ..... E04F 21/22 254/16
319,464 A * 6/1885 Dearth ..... E04F 21/22 254/14
D321,351 S * 11/1991 Kirchner ..... D14/138 R
7,954,300 B1 * 6/2011 Kufner ..... E04F 21/22 33/526
7,976,939 B2 * 7/2011 Hojaji ..... B32B 5/18 428/316.6
8,079,199 B1 * 12/2011 Kufner ..... E04F 13/0892 33/526
8,291,649 B2 * 10/2012 Kelly ..... B66C 1/666 52/125.5
8,429,878 B1 * 4/2013 Hoffman ..... E04F 13/0889 52/747.11
8,966,835 B1 * 3/2015 Hoffman ..... E04F 21/0092 52/122.1
9,027,308 B2 * 5/2015 Kufner ..... E04F 21/22 52/749.11
9,758,983 B2 * 9/2017 Simmons ..... B66C 1/62
9,938,714 B2 * 4/2018 Dicaire ..... E04B 1/2604
10,047,530 B2 * 8/2018 Bunch ..... E04F 21/1844
10,151,118 B2 * 12/2018 Irvine ..... E04F 21/0092
2010/0287868 A1 * 11/2010 Kufner ..... E04F 21/0092 52/391
2013/0247508 A1 * 9/2013 Hoffman ..... E04F 21/00 52/749.11

(Continued)

FOREIGN PATENT DOCUMENTS

CA 2868834 A1 * 10/2013 ..... E04F 21/22
CA 2881270 A1 * 2/2014 ..... E04F 21/0092

(Continued)

*Primary Examiner* — Jeanette E Chapman
(74) *Attorney, Agent, or Firm* — Alan D. Kamrath; Kamrath IP Lawfirm, P.A.

(57) ABSTRACT

A tile leveling structure includes a fixture, a leveling member mounted on the fixture, a first wing pivotally connected with the leveling member, and a second wing pivotally connected with the leveling member. The first wing is provided with a first push section and a first pressing face. The second wing is provided with a second push section and a second pressing face. When the first push section of the first wing and the second push section of the second wing are pushed, the first pressing face of the first wing and the second pressing face of the second wing are moved to respectively press the first tile and the second tile so as to level the first tile and the second tile.

9 Claims, 11 Drawing Sheets

(56) References Cited

U.S. PATENT DOCUMENTS

| | | | | |
|---|---|---|---|---|
| 2014/0116001 | A1* | 5/2014 | Ghelfi | E04F 21/0092 52/749.11 |
| 2014/0325935 | A1* | 11/2014 | Hoffman | E04F 21/22 52/747.11 |
| 2015/0240504 | A1* | 8/2015 | Hoffman | E04F 21/20 29/244 |
| 2016/0222679 | A1* | 8/2016 | Bunch | E04F 21/1844 |
| 2017/0044779 | A1* | 2/2017 | Teng | E04F 21/1877 |
| 2018/0355622 | A1* | 12/2018 | Bunch | E04F 21/1844 |
| 2018/0355623 | A1* | 12/2018 | Frisco | E04F 21/22 |

FOREIGN PATENT DOCUMENTS

| | | | | |
|---|---|---|---|---|
| CA | 2982990 | A1 * | 5/2018 | B23B 47/28 |
| EP | 2921609 | A1 * | 9/2015 | E04F 13/0892 |
| WO | WO-2016201502 | A1 * | 12/2016 | E04F 21/22 |

* cited by examiner

TILE LEVELING STRUCTURE

BACKGROUND OF THE INVENTION

1. Field of the Invention

The present invention relates to a leveling structure and, more particularly, to a tile leveling structure.

2. Description of the Related Art

A conventional tile leveling structure in accordance with the prior art shown in FIGS. 1 and 2 comprises a base 10, an adjusting plate 11 integrally formed on and extending upward from the base 10, a oneway toothed rack 13 mounted on the adjusting plate 11 and located adjacent to the top end 12 of the adjusting plate 11, and a leveling member 20 movably mounted on the adjusting plate 11. The base 10 and the adjusting plate 11 have a connection formed with a breaking point 14. The adjusting plate 11 is made of plastic material with resilience and flexibility. The leveling member 20 has a hollow inside and has an upper end provided with an operation face 21 and a lower end provided with an abutting face 22. The operation face 21 of the leveling member 20 is provided with a through hole 23 allowing passage of the adjusting plate 11, with the top end 12 of the adjusting plate 11 protruding outward from the through hole 23 of the operation face 21. The through hole 23 of the operation face 21 has two sides each provided with a oneway ratchet toothed portion 24 meshing with the oneway toothed rack 13 of the adjusting plate 11. In operation, cement is applied on the ground. Then, a first tile "P1" is placed on the cement. Then, the base 10 is placed on the cement, with a first side of the base 10 being inserted between the first tile "P1" and the cement. Then, a second tile "P2" is placed on the cement, with a second side of the base 10 being sandwiched between the second tile "P2" and the cement. In such a manner, the second tile "P2" is juxtaposed to the first tile "P1". Then, the leveling member 20 is mounted on the adjusting plate 11, with the top end 12 of the adjusting plate 11 passing through the through hole 23 of the leveling member 20, and with the oneway ratchet toothed portion 24 of the leveling member 20 meshing with the oneway toothed rack 13 of the adjusting plate 11. Then, a pair of pulling pliers are placed on the operation face 21 of the leveling member 20 and clamp the adjusting plate 11. Then, the pulling pliers are operated successively to pull the adjusting plate 11 and to push the operation face 21 of the leveling member 20 so as to move the leveling member 20 downward as indicated by arrows "L1" shown in FIG. 2, so that the leveling member 20 is moved toward the base 10 until the abutting face 22 of the leveling member 20 abuts the first tile "P1" and the second tile "P2". At this time, the oneway ratchet toothed portion 24 of the leveling member 20 meshes with the oneway toothed rack 13 of the adjusting plate 11 to prevent the leveling member 20 from being moved upward. Thus, the first tile "P1" and the second tile "P2" are pressed and leveled by the abutting face 22 of the leveling member 20. After the cement is dried, the operator may kick or strike the leveling member 20, to break the breaking point 14, and to detach the adjusting plate 11 from the base 10, so that the leveling member 20 and the adjusting plate 11 are removed from the first tile "P1" and the second tile "P2". However, the operator has to operate the leveling member 20 by aid of a hand tool (such as the pulling pliers), thereby causing inconvenience to the operator when operating the conventional tile leveling structure. In addition, the operator needs to carry the hand tool for operating the conventional tile leveling structure, thereby causing a burden to the operator. Further, when the pulling pliers are operated to pull the adjusting plate 11 and to push the leveling member 20, the force is applied to and tolerated by the breaking point 14, so that the breaking point 14 is easily broken during operation of the pulling pliers.

BRIEF SUMMARY OF THE INVENTION

The primary objective of the present invention is to provide a tile leveling structure that levels tiles easily and quickly.

In accordance with the present invention, there is provided a tile leveling structure comprising a fixture, a leveling member mounted on the fixture, a first wing pivotally connected with the leveling member, and a second wing pivotally connected with the leveling member. The fixture includes a base, and an adjusting plate formed on and extending upward from the base. The base and the adjusting plate have a connection formed with a breaking point. The leveling member is provided with a passage, and the adjusting plate of the fixture passes through the passage of the leveling member. The leveling member has a bottom face which has a first side provided with a first seat and a second side provided with a second seat. The first seat is provided with a first pivot hole. The second seat is provided with a second pivot hole. The leveling member has a top face which has a first side provided with a first locking portion and a second side provided with a second locking portion. The first wing is provided with a first shaft hole, and a first shaft extends through the first shaft hole of the first wing and the first pivot hole of the first seat, so that the first wing is pivotally connected with the first seat of the leveling member. The first wing has an upper end provided with a first push section and a lower end provided with a first pressing face. The first push section of the first wing extends upward from the first pressing face and has a side provided with a first engaging portion. The second wing is provided with a second shaft hole, and a second shaft extends through the second shaft hole of the second wing and the second pivot hole of the second seat so that the second wing is pivotally connected with the second seat of the leveling member. The second wing has an upper end provided with a second push section and a lower end provided with a second pressing face. The second push section of the second wing extends upward from the second pressing face and has a side provided with a second engaging portion.

According to the primary advantage of the present invention, when the first push section of the first wing and the second push section of the second wing are pushed, the first pressing face of the first wing and the second pressing face of the second wing are moved to respectively press the first tile and the second tile tightly and closely so as to level the first tile and the second tile exactly, so that the tile leveling structure is operated by the user easily and conveniently.

According to another advantage of the present invention, the operator only needs to press the first push section of the first wing and the second push section of the second wing so as to level the first tile and the second tile, so that the tile leveling structure is operated by the user's manual labor without needing aid of any hand tool, thereby facilitating the operator leveling the tiles.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
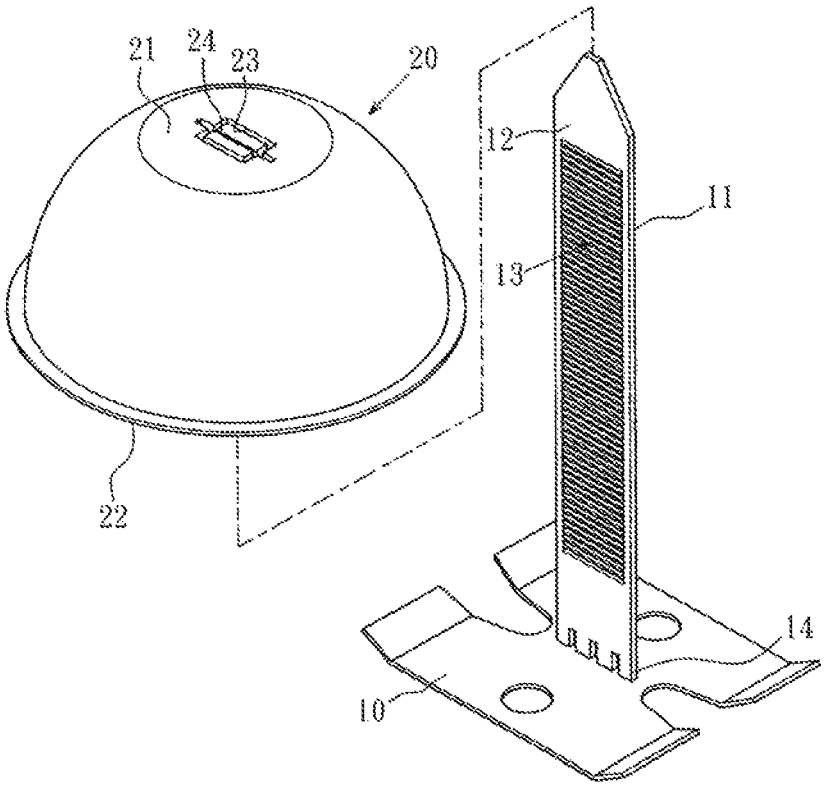
FIG. 1 PRIOR ART
FIG. 1 is an exploded perspective view of a conventional tile leveling structure in accordance with the prior art.
Figure 2:
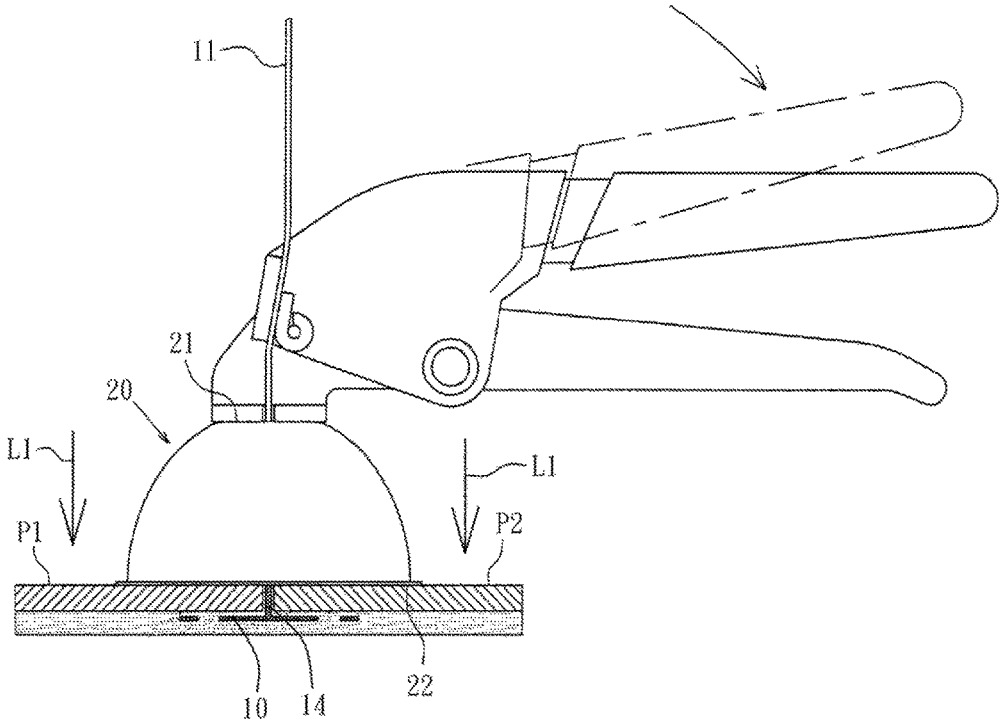
FIG. 2 PRIOR ART
FIG. 2 is a cross-sectional operational view showing operation of the conventional tile leveling structure in accordance with the prior art.
Figure 3:
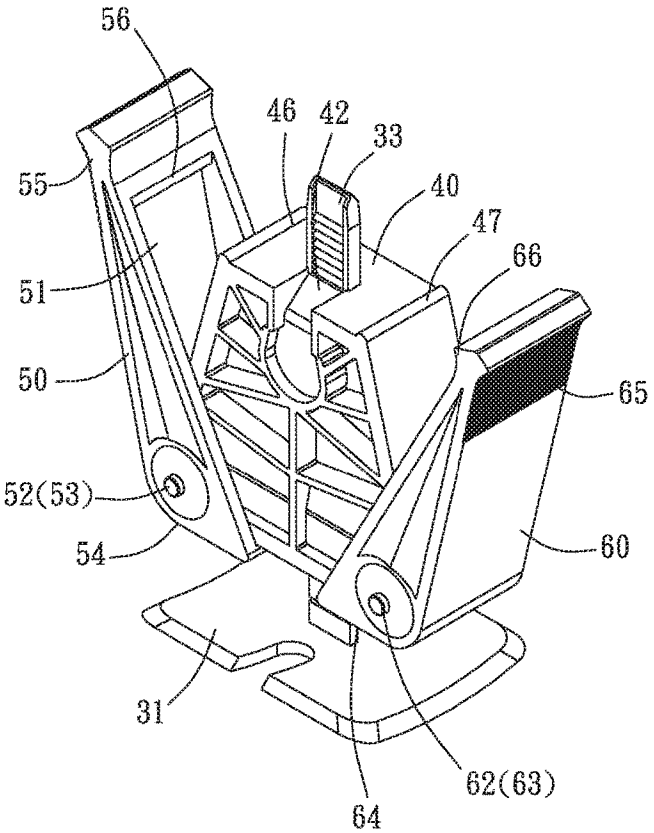
FIG. 3 is a perspective view of a tile leveling structure in accordance with the preferred embodiment of the present invention.
Figure 4:
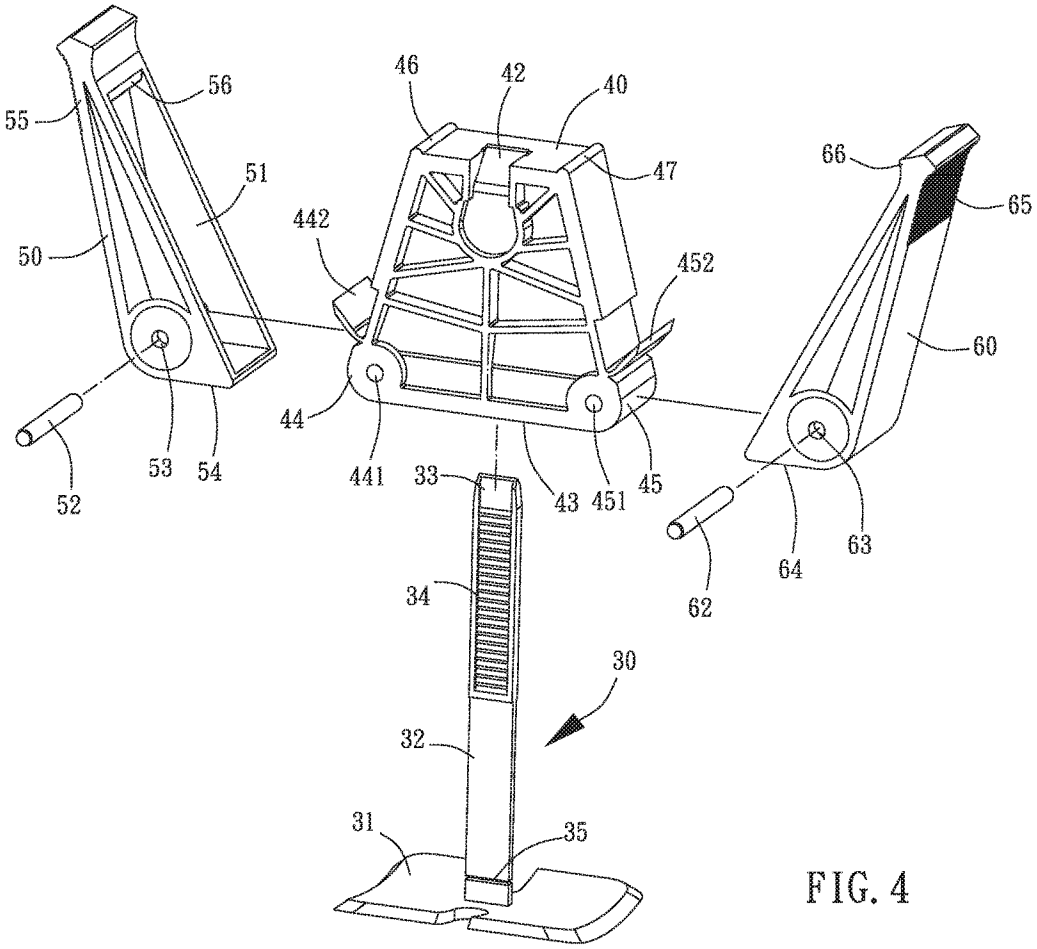
FIG. 4 is an exploded perspective view of the tile leveling structure in accordance with the preferred embodiment of the present invention.
Figure 5:
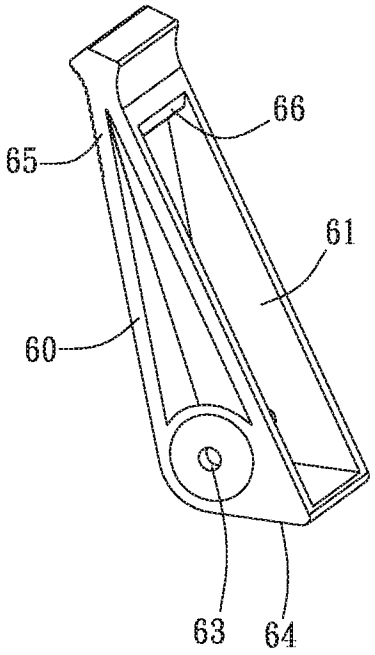
FIG. 5 is a perspective view of a second wing of the tile leveling structure in accordance with the preferred embodiment of the present invention.
Figure 7:
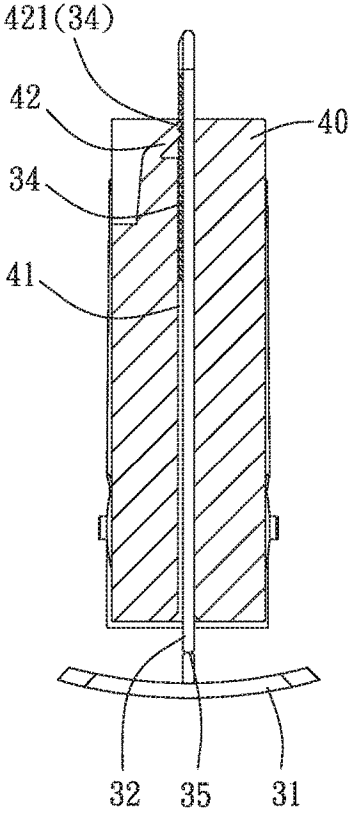
FIG. 7 is a side cross-sectional view of the tile leveling structure as shown in FIG. 3.
Figure 6:
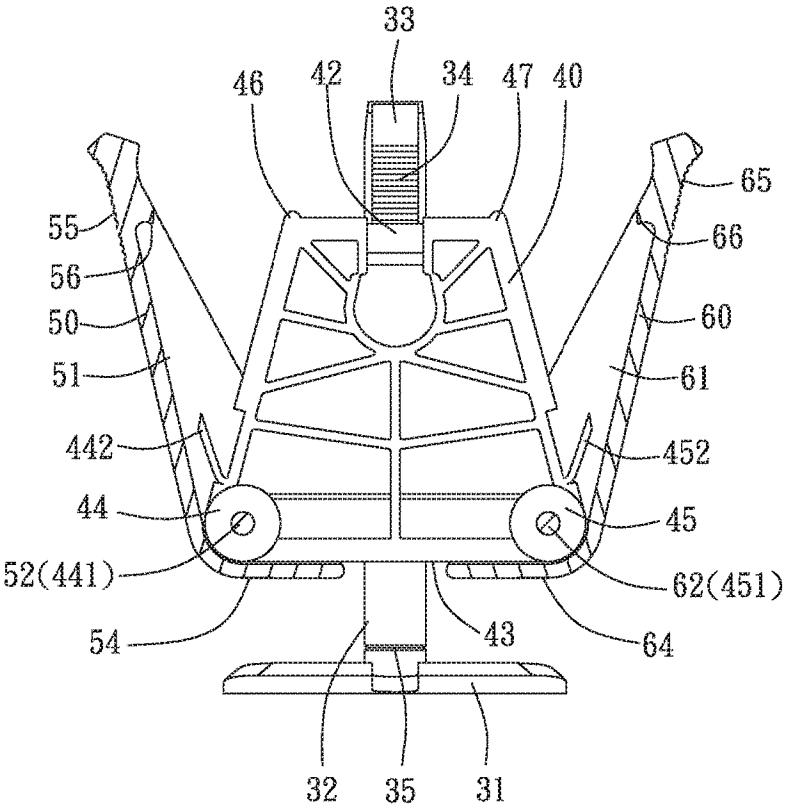
FIG. 6 is a front cross-sectional view of the tile leveling structure as shown in FIG. 3.

Referring to the drawings and initially to FIGS. 3-7, a tile leveling structure in accordance with the preferred embodiment of the present invention comprises a fixture 30, a leveling member 40 mounted on the fixture 30, a first wing 50 pivotally connected with the leveling member 40, and a second wing 60 pivotally connected with the leveling member 40.

The fixture 30 includes a base 31, and an adjusting plate 32 formed on and extending upward from the base 31. The base 31 and the adjusting plate 32 have a connection formed with a breaking point 35.

The leveling member 40 is provided with a passage 41 (FIG. 7), and the adjusting plate 32 of the fixture 30 passes through the passage 41 of the leveling member 40. The passage 41 extends longitudinally through the whole length of the leveling member 40. The leveling member 40 has a bottom face 43 which has a first side provided with a first seat 44 and a second side provided with a second seat 45. The first seat 44 is provided with a first pivot hole 441. The second seat 45 is provided with a second pivot hole 451. The leveling member 40 has a top face which has a first side provided with a first locking portion 46 and a second side provided with a second locking portion 47.

The first wing 50 is provided with a first shaft hole 53, and a first shaft 52 extends through the first shaft hole 53 of the first wing 50 and the first pivot hole 441 of the first seat 44, so that the first wing 50 is pivotally connected with the first seat 44 of the leveling member 40. The first wing 50 has an upper end provided with a first push section 55 and a lower end provided with a first pressing face 54. The first push section 55 of the first wing 50 extends upward from the first pressing face 54 and has a side provided with a first engaging portion 56.

The second wing 60 is provided with a second shaft hole 63, and a second shaft 62 extends through the second shaft hole 63 of the second wing 60 and the second pivot hole 451 of the second seat 45 so that the second wing 60 is pivotally connected with the second seat 45 of the leveling member 40. The second wing 60 has an upper end provided with a second push section 65 and a lower end provided with a second pressing face 64. The second push section 65 of the second wing 60 extends upward from the second pressing face 64 and has a side provided with a second engaging portion 66.

In the preferred embodiment of the present invention, the fixture 30 further includes a oneway toothed rack 34 mounted on the adjusting plate 32 and located adjacent to a top end 33 of the adjusting plate 32, and the leveling member 40 has an upper end provided with a limit strip 42 engaging the oneway toothed rack 34 of the fixture 30. The limit strip 42 and the leveling member 40 are formed integrally. The limit strip 42 is flexible and provided with a plurality of locking teeth 421 meshing with the oneway toothed rack 34 of the fixture 30, so that the oneway toothed rack 34 of the fixture 30 only allows the leveling member 40 moving downward relative to the fixture 30, and prohibits the leveling member 40 from moving upward relative to the fixture 30. The locking teeth 421 of the limit strip 42 is directed toward the passage 41 of the leveling member 40.

In the preferred embodiment of the present invention, the leveling member 40 is provided with a first elastic plate 442 located above the first pivot hole 441 of the first seat 44, and a second elastic plate 452 located above the second pivot hole 451 of the second seat 45.

In the preferred embodiment of the present invention, the first wing 50 is provided with a first receiving chamber 51 mounted on and receiving the first seat 44 of the leveling member 40, and the second wing 60 is provided with a second receiving chamber 61 (FIG. 5) mounted on and receiving the second seat 45 of the leveling member 40.

In the preferred embodiment of the present invention, an angle defined between the first pressing face 54 and the first push section 55 of the first wing 50 is greater than that defined between the bottom face 43 and the first seat 44 of the leveling member 40, and an angle defined between the second pressing face 64 and the second push section 65 of the second wing 60 is greater than that defined between the bottom face 43 and the second seat 45 of the leveling member 40.

Figure 8:
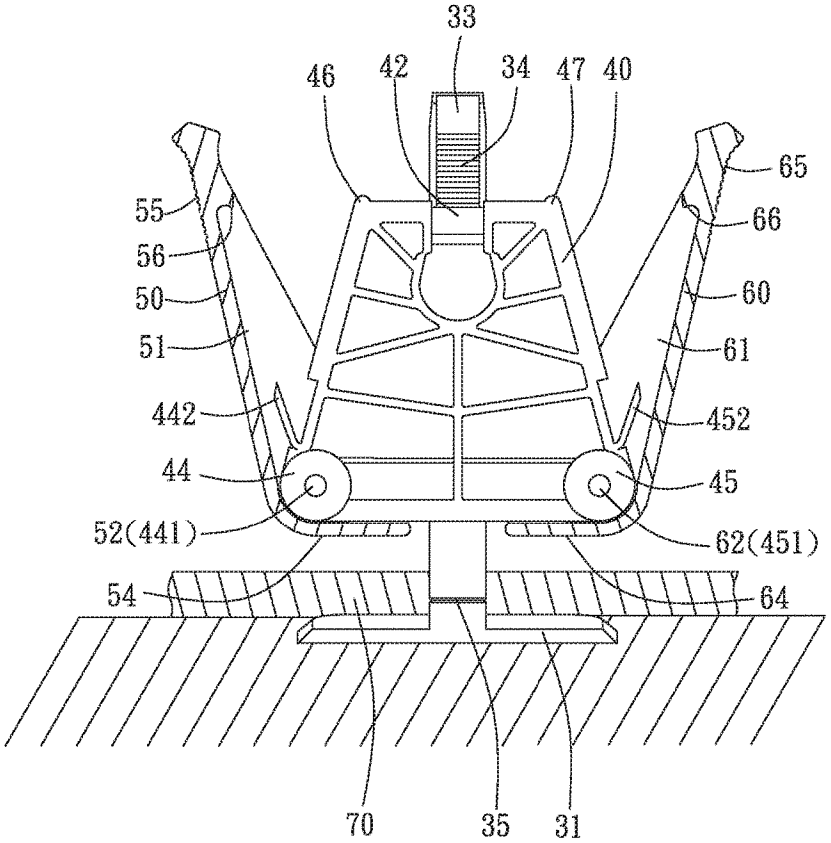
FIG. 8 is a schematic operational view of the tile leveling structure as shown in FIG. 6 in use.

In operation, referring to FIG. 8 with reference to FIGS. 3-7, cement is initially applied on the ground. Subsequently, a first tile is placed on the cement. Then, the base 31 of the fixture 30 is placed on the cement, with a first side of the base 31 being inserted between the first tile and the cement. Then, a second tile is placed on the cement, with a second side of the base 31 being sandwiched between the second tile and the cement. In such a manner, the second tile is juxtaposed to the first tile. At this time, the first tile and the second tile are not leveled and have height differential. Then, the leveling member 40 is mounted on the adjusting plate 32 of the fixture 30, with the top end 33 of the adjusting plate 32 being inserted into and passing through the passage 41 of the leveling member 40. Thus, the leveling member 40 is moved downward along the adjusting plate 32 of the fixture 30 toward the first tile and the second tile until the first pressing face 54 of the first wing 50 touches the first tile, and the second pressing face 64 of the second wing 60 touches the second tile. At this time, the locking teeth 421 of the limit strip 42 mesh with and interlock the oneway toothed rack 34 of the fixture 30, and the upward movement the leveling member 40 is refrained by the oneway toothed rack 34 of the fixture 30, so that the leveling member 40 is locked on the adjusting plate 32 of the fixture 30, while the first pressing face 54 of the first wing 50 and the second pressing face 64 of the second wing 60 respectively rest on the first tile and the second tile.

Figure 9:
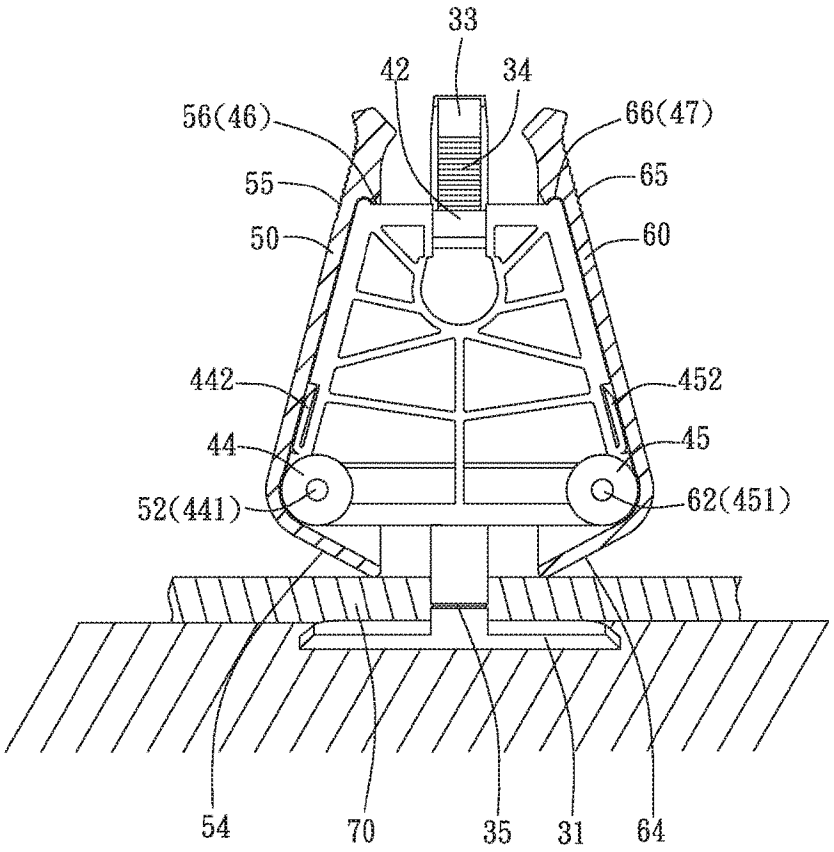
FIG. 9 is a schematic operational view of the tile leveling structure as shown in FIG. 8.

Referring now to FIG. 9 with reference to FIGS. 3-8, when the first push section 55 of the first wing 50 and the second push section 65 of the second wing 60 are pushed toward the leveling member 40, the first wing 50 is pivoted about the first shaft 52, and the second wing 60 is pivoted about the second shaft 62, so that the first pressing face 54 of the first wing 50 and the second pressing face 64 of the second wing 60 are moved to press the first tile and the second tile respectively. At this time, the angle defined between the first pressing face 54 and the first push section 55 of the first wing 50 is greater than that defined between the bottom face 43 and the first seat 44 of the leveling member 40, to provide a space for allowing rotation of the first wing 50, while the angle defined between the second pressing face 64 and the second push section 65 of the second wing 60 is greater than that defined between the bottom face 43 and the second seat 45 of the leveling member 40 to provide a space for allowing rotation of the second wing 60. Thus, the first pressing face 54 of the first wing 50 and the second pressing face 64 of the second wing 60 respectively press the first tile and the second tile tightly and closely so as to level the first tile and the second tile exactly. In such a manner, multiple tiles 70 are leveled by the tile leveling structure to provide a flat and smooth surface. It is appreciated that, when the first pressing face 54 of the first wing 50 and the second pressing face 64 of the second wing 60 press the first tile and the second tile, the first engaging portion 56 of the first wing 50 is locked onto the first locking portion 46 of the leveling member 40, and the second engaging portion 66 of the second wing 60 is locked onto the second locking portion 47 of the leveling member 40. At the same time, the first elastic plate 442 of the leveling member 40 is received in the first receiving chamber 51 of the first wing 50 and compressed by the first wing 50 to store a restoring force, and the second elastic plate 452 of the leveling member 40 is received in the second receiving chamber 61 of the second wing 60 and compressed by the second wing 60 to store a restoring force.

After the cement is dried, the operator kicks or strikes the leveling member 40, to break the breaking point 35 of the adjusting plate 32, and to detach the adjusting plate 32 from the base 31, so that the leveling member 40 and the adjusting plate 32 are removed from the first tile and the second tile, with the base 31 being located beneath the first tile and the second tile. Then, the top end 33 of the adjusting plate 32 is pulled upward by the operator to remove the adjusting plate 32 from the leveling member 40, so that the leveling member 40 can be reused and recycled. At this time, the first wing 50 and the second wing 60 are pushed outward by the restoring force of the first elastic plate 442 and the second elastic plate 452 of the leveling member 40 to return the original state.

Accordingly, when the first push section 55 of the first wing 50 and the second push section 65 of the second wing 60 are pushed, the first pressing face 54 of the first wing 50 and the second pressing face 64 of the second wing 60 are moved to respectively press the first tile and the second tile tightly and closely so as to level the first tile and the second tile exactly, so that the tile leveling structure is operated by the user easily and conveniently. In addition, the operator only needs to press the first push section 55 of the first wing 50 and the second push section 65 of the second wing 60 so as to level the first tile and the second tile, so that the tile leveling structure is operated by the user's manual labor without needing aid of any hand tool, thereby facilitating the operator leveling the tiles.

Figure 10:
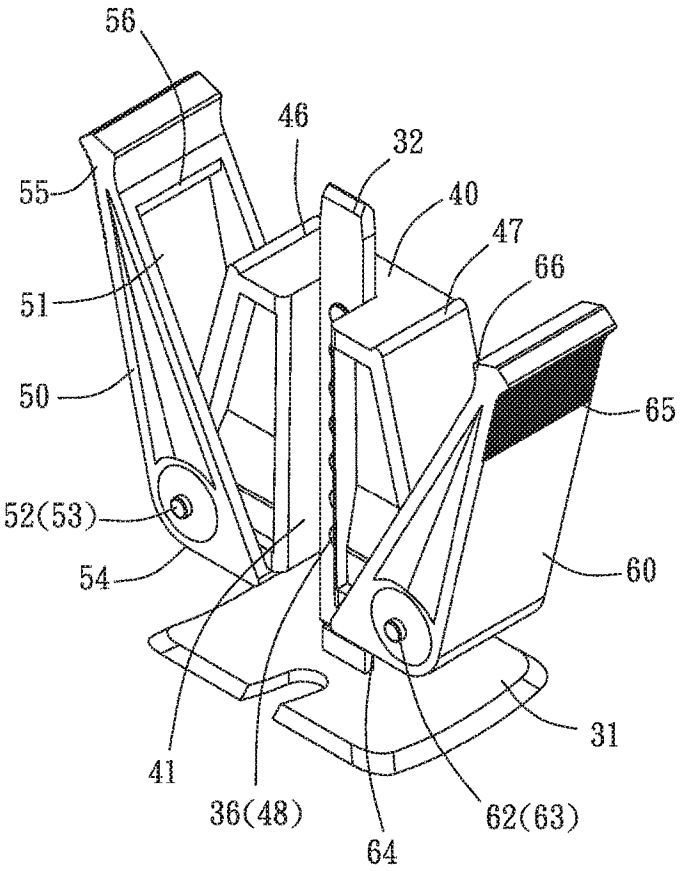
FIG. 10 is a perspective view of a tile leveling structure in accordance with another preferred embodiment of the present invention.
Figure 11:
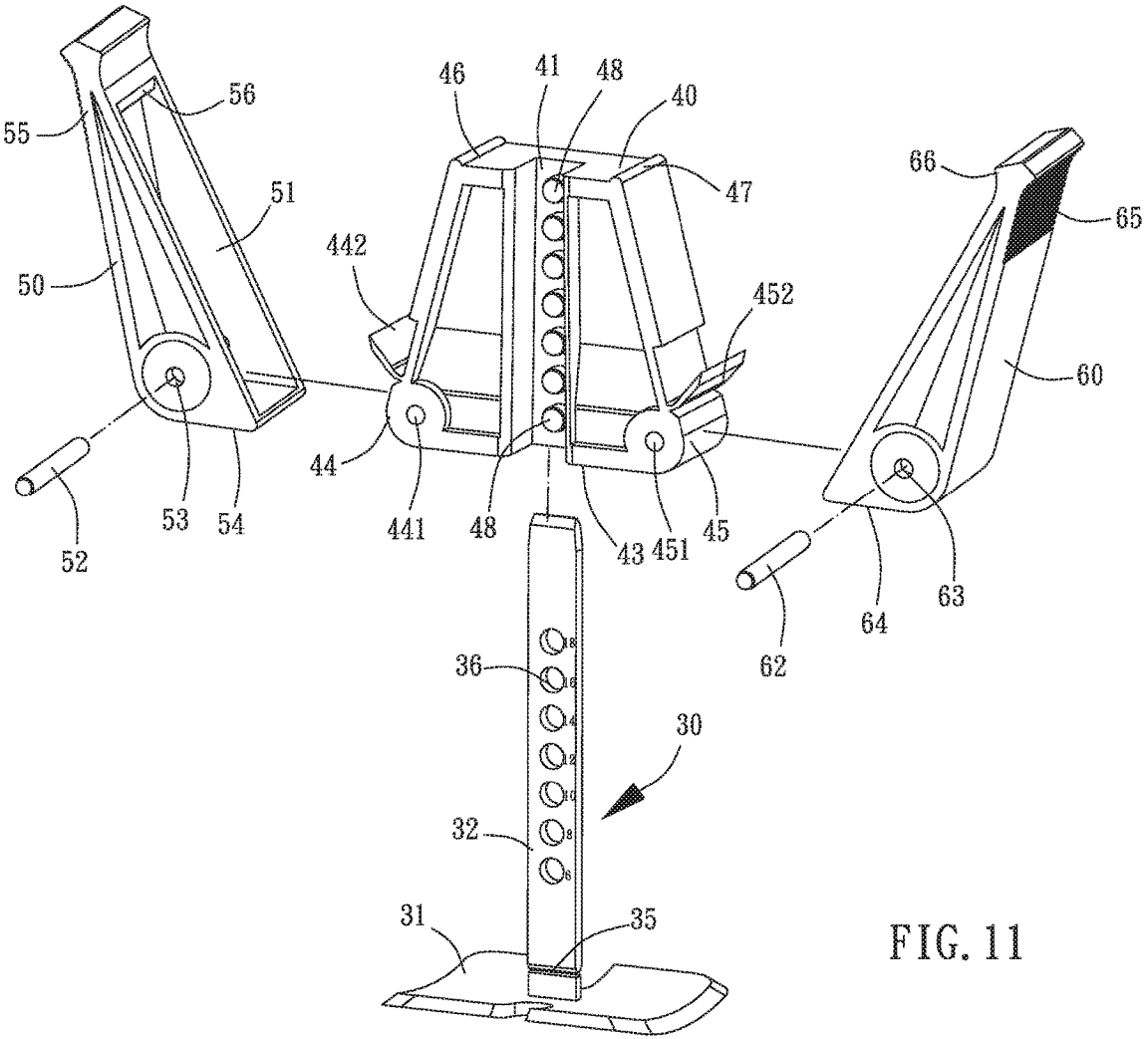
FIG. 11 is an exploded perspective view of the tile leveling structure as shown in FIG. 10.
Figure 12:
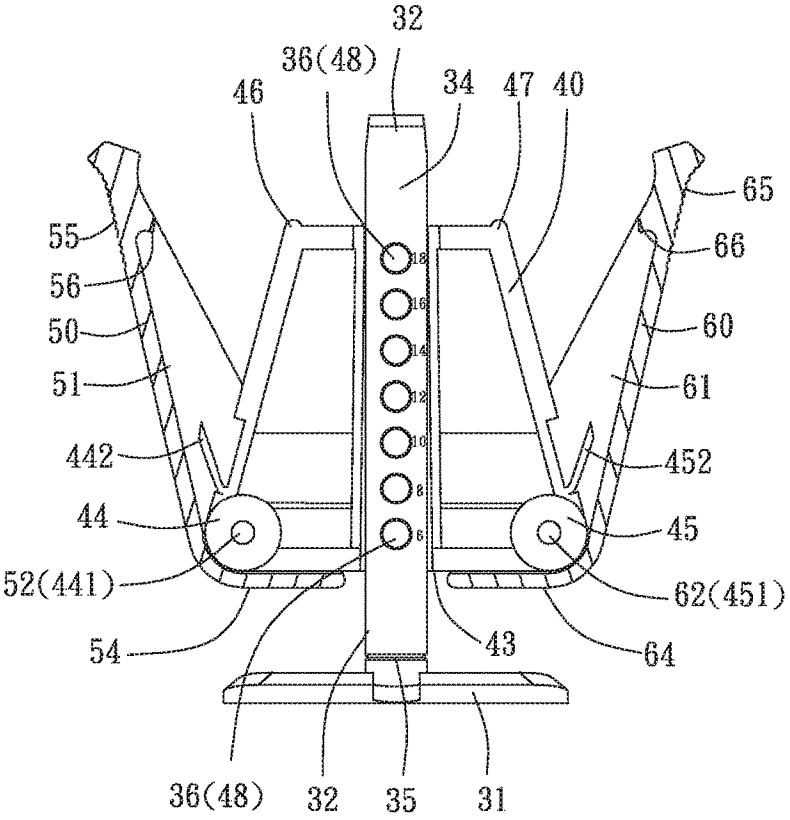
FIG. 12 is a front cross-sectional view of the tile leveling structure as shown in FIG. 10.

Referring now to FIGS. 10-12, the adjusting plate 32 of the fixture 30 is provided with a plurality of positioning holes 36, and the leveling member 40 is provided with a plurality of mounting rods 48. The passage 41 extends the leveling member 40 from outside to inside and has an open side, with the mounting rods 48 being exposed from the passage 41. The adjusting plate 32 of the fixture 30 is sideward mounted on the passage 41 of the leveling member 40. The mounting rods 48 of the leveling member 40 are received in the passage 41 and are inserted into the positioning holes 36 of the adjusting plate 32. Preferably, the adjusting plate 32 of the fixture 30 is provided with a plurality of indication marks corresponding to the positioning holes 36 to correspond to tiles of different thickness. In such a manner, the mounting rods 48 of the leveling member 40 are mounted in the positioning holes 36 of the adjusting plate 32 according to the thickness of each of the tiles. For example, when the thickness of each of the tiles is equal to 6 cm, the lowermost one of the mounting rods 48 is inserted into one of the positioning holes 36 with an indication mark of "6". Thus, the leveling member 40 is positioned on the adjusting plate 32 of the fixture 30 easily and exactly.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the scope of the invention.

The invention claimed is:

1. A tile leveling structure comprising:

a fixture;

a leveling member mounted on the fixture;

a first wing pivotally connected with the leveling member; and a second wing pivotally connected with the leveling member;

wherein:

the fixture includes a base, and an adjusting plate formed on and extending upward from the base;

the base and the adjusting plate have a connection formed with a breaking point;

the leveling member is provided with a passage;

the adjusting plate of the fixture passes through the passage of the leveling member;

the leveling member has a bottom face which has a first side provided with a first seat and a second side provided with a second seat;

the first seat is provided with a first pivot hole;

the second seat is provided with a second pivot hole;

the leveling member has a top face which has a first side provided with a first locking portion and a second side provided with a second locking portion;

the first wing is provided with a first shaft hole;

a first shaft extends through the first shaft hole of the first wing and the first pivot hole of the first seat, so that the first wing is pivotally connected with the first seat of the leveling member;

the first wing has an upper end provided with a first push section and a lower end provided with a first pressing face;

the first push section of the first wing extends upward from the first pressing face and has a side provided with a first engaging portion;

the second wing is provided with a second shaft hole;

a second shaft extends through the second shaft hole of the second wing and the second pivot hole of the second seat so that the second wing is pivotally connected with the second seat of the leveling member;

the second wing has an upper end provided with a second push section and a lower end provided with a second pressing face; and the second push section of the second wing extends upward from the second pressing face and has a side provided with a second engaging portion.

2. The tile leveling structure of claim 1, wherein:

the fixture further includes a oneway toothed rack mounted on the adjusting plate and located adjacent to a top end of the adjusting plate;

the leveling member has an upper end provided with a limit strip engaging the oneway toothed rack of the fixture;

the limit strip is provided with a plurality of locking teeth meshing with the oneway toothed rack of the fixture; and the locking teeth of the limit strip is directed toward the passage of the leveling member.

3. The tile leveling structure of claim 1, wherein the leveling member is provided with a first elastic plate located above the first pivot hole of the first seat, and a second elastic plate located above the second pivot hole of the second seat.

4. The tile leveling structure of claim 1, wherein the first wing is provided with a first receiving chamber mounted on and receiving the first seat of the leveling member, and the second wing is provided with a second receiving chamber mounted on and receiving the second seat of the leveling member.

5. The tile leveling structure of claim 1, wherein an angle defined between the first pressing face and the first push section of the first wing is greater than that defined between the bottom face and the first seat of the leveling member, and an angle defined between the second pressing face and the second push section of the second wing is greater than that defined between the bottom face and the second seat of the leveling member.

6. The tile leveling structure of claim 1, wherein the adjusting plate of the fixture is provided with a plurality of positioning holes, and the leveling member is provided with a plurality of mounting rods.

7. The tile leveling structure of claim 6, wherein the passage extends the leveling member from outside to inside and has an open side, with the mounting rods being exposed from the passage, and the adjusting plate of the fixture is sideward mounted on the passage of the leveling member.

8. The tile leveling structure of claim 6, wherein the mounting rods of the leveling member are inserted into the positioning holes of the adjusting plate.

9. The tile leveling structure of claim 6, wherein the mounting rods of the leveling member are received in the passage.

* * * * *